US005755272A

United States Patent [19]

Mortensen et al.

[11] Patent Number: 5,755,272

[45] Date of Patent: May 26, 1998

[54] METHOD FOR PRODUCING METAL MATRIX COMPOSITES USING ELECTROMAGNETIC BODY FORCES

[75] Inventors: Andreas Mortensen, Cambridge; Richard M. Andrews, Westborough; Merton C. Flemings, Cambridge, all of Mass.

[73] Assignee: Massachusetts Institute of Technology, Cambridge, Mass.

[21] Appl. No.: 658,427

[22] Filed: Mar. 27, 1996

Related U.S. Application Data

[63] Continuation of Ser. No. 157,051, filed as PCT/US91/03994, Jun. 6, 1991, abandoned.

[51] Int. Cl.[6] ..... B22D 27/02

[52] U.S. Cl. ..... 164/48; 164/498; 164/97; 164/98

[58] Field of Search ..... 164/498, 147.1, 164/97, 98, 466, 461, 502, 48

[56] References Cited

U.S. PATENT DOCUMENTS

| | | | |
|---|---|---|---|
| 3,547,180 | 12/1970 | Cochran et al. . | |
| 4,033,400 | 7/1977 | Gurwell et al. . | |
| 4,506,721 | 3/1985 | Ban et al. . | |
| 4,561,489 | 12/1985 | Dantzig et al. | 164/498 |
| 4,828,015 | 5/1989 | Takeuchi et al. . | |

FOREIGN PATENT DOCUMENTS

| | | | |
|---|---|---|---|
| 57-25275 | 2/1982 | Japan . | |
| 61-132259 | 11/1984 | Japan | 164/97 |
| 60-077946 | 5/1985 | Japan . | |
| 62-161450 | 7/1987 | Japan . | |
| 2-295665 | 12/1990 | Japan | 164/97 |
| 407631 | 4/1974 | U.S.S.R. . | |
| 671919 | 7/1979 | U.S.S.R. . | |
| 1109255 | 8/1984 | U.S.S.R. . | |

OTHER PUBLICATIONS

A.I. Raichenko, "Theory and Technology of Sintering, Thermal, and Chemicothermal Treatment Processes–Theory of Infiltration of a Porous Medium Under the Influence of Electric Current," Translated from *Poroshkovaya Metallurgiya*, No. 4(220), pp. 5–9, Apr., 1981.

A. I. Raichenko, "Theory and Technology of Sintering, Thermal, and Chemicothermal Treatment Processes–Effect of an Electric Current on the Infiltration of a Porous Medium in Liquid Metal," Translated from *Poroshkovaya Metallurgiya*, No. 2(230), pp. 32–37, Feb., 1982.

O.N. Ryabinina, A.I. Raichenko, and V.V. Pushkarev, "Theory and Technology of Sintering, Thermal, and Chemicothermal Treatment Processes–Infiltration of Graphite by Aluminum during Electric–Discharge Sintering," Translated from *Poroshkovaya Metallurgiya*, No. 3(231), pp. 26–28, Mar., 1982.

A.I. Raichenko, V.I. Grigorev, VI.K. Mai, N.D. Petrina, and N.P. Sleptsova, "Forced Filtration of a Liquid Alloy in a Porous Material Under the Influence of Electromagnetic Forces," Translated from *Poroshkovaya Metallurgiya*, No. 11(83), pp 40–44, Nov., 1969.

A.I. Raichenko, "Theory and Technology of Sintering, Thermal, and Chemicothermal Treatment Processes–Theoretical Analysis of the Infiltration of a Medium with Interconnected Pores During the Passage of Electric Current," Translated from *Poroshkovaya Metallurgiya*, No. 8(200), pp. 27–31, Aug., 1979.

*Primary Examiner*—Joseph J. Hail, III
*Assistant Examiner*—I. H. Lin
*Attorney, Agent, or Firm*—Choate, Hall & Stewart

[57] ABSTRACT

Method for producing metal matrix composites. The method includes the steps of placing a substantially liquid metal in the vicinity of a reinforcement material and in the vicinity of the source of a transient magnetic field sufficient to produce an electromagnetic body force within the metal. The magnetic field is activated thereby propelling the substantially liquid metal into the reinforcement material thereby producing metal matrix composites.

20 Claims, 7 Drawing Sheets

METHOD FOR PRODUCING METAL MATRIX COMPOSITES USING ELECTROMAGNETIC BODY FORCES

CROSS-REFERENCE TO RELATED APPLICATION

This application is a continuation of U.S. patent application Ser. No. 08/157,051, filed Dec. 2, 1993 and now abandoned, which is a 371 of PCT/US91/03994 filed Jun. 6, 1991.

BACKGROUND OF THE INVENTION

This invention relates to the production of metal matrix composites using electromagnetic body forces to drive molten metal into a reinforcing material.

The remarkable structural materials that can result from reinforcing a metal with a stiff, strong ceramic phase such as modern carbon or alumina fibers have generated much interest in the development of economical fabrication routes for these materials. Of the numerous methods that have been used to produce such materials, casting processes stand out as among the most attractive. Light matrices such as aluminum are favored due to their potential for low cost and net shape component fabrication. These methods were recently reviewed in Mortensen et al., "Solidification Processing of Metal-Matrix Composites," 40 *Journal of Metals* 2, Feb. 1988 at pages 12–19.

Processes for casting metal matrix composites currently use applied pressure (i) to overcome capillary forces at the infiltration front of the liquid metal matrix material as it advances into the reinforcement material and (ii) to minimize processing times and hence both costs and the extent of chemical reaction between matrix and reinforcement materials in reactive systems. Metal pressurization is obtained by mechanical means, via a piston (as in squeeze casting) or pressurized gas (as in the Cray process). Many pressure infiltration devices have thus been designed, such as the squeeze casting presses presently in use for fabricating the mass marketed metal matrix component, an aluminum Toyota diesel engine piston selectively reinforced with a alumina fibers.

SUMMARY OF THE INVENTION

A new method and apparatus for driving molten metal into a preformed reinforcing phase is described, using electromagnetic body forces. While electromagnetically induced body forces have been used in other materials processing operations such as electroforming solid metals, such forces are used here for the first time to induce flow of liquid metal into a reinforcement material such as particles, fibers, or a preform to produce composite materials.

According to the invention, sufficiently strong electric and magnetic fields interact to create an electromagnetic body force in a liquid metal. This force can be used to propel the liquid metal in a chosen direction. The use of such a force is an efficient method for the production of metal matrix composites. In one embodiment, the electric and magnetic fields can be produced by a current discharge through a coil of conducting material placed in the vicinity of the liquid metal which is to form the matrix of the composite. This current creates a transient magnetic field B within a certain thickness of the metal, which in turn creates a transient eddy current j in the molten metal. The two fields within the molten metal create a body force $F=j\times B$, called the Lorentz force, which is used to propel the matrix into the preform.

In general, the invention features, in one aspect, a method for the production of metal matrix composites, including placing a substantially liquid metal in the vicinity of a reinforcement material and the source of an inactive transient magnetic field, sufficient, when activated, to produce an electromagnetic body force within the metal through the interaction of the transient magnetic field and eddy currents induced by the transient field within the metal, and activating the transient magnetic field, thereby propelling the substantially liquid metal into the reinforcement material.

In preferred embodiments, the activating step is repeated; quantities of the liquid metal and the reinforcement material are continuously provided, including the additional step of withdrawing from the vicinity of the source of the transient magnetic field the reinforcement material into which metal has been propelled; the metal includes at least one of or includes an alloy comprising aluminum, nickel, cobalt, copper, beryllium, lead, tin, zinc, magnesium, titanium, or iron; the reinforcement material includes a ceramic; the reinforcement material includes fibers, whiskers, particles platelets, or rods; the reinforcement material is shaped into a preform; the reinforcement material includes at least one of silicon carbide, boron, tungsten, carbon, silicon nitride, boron carbide, silicon oxide, aluminum oxide, titanium, or steel; the propelling step additionally includes subjecting the substantially liquid metal to an electrical field; the transient magnetic field is produced by a discharge coil through which electric current is passed; the frequency and damping constant of the repeatedly activated transient magnetic field are tailored to the geometry of the discharge coil, reinforcement material, metal, and the depth to which the metal is to be propelled into the reinforcement material; the current is an oscillating current; the transient magnetic field is produced by a discharge coil coupled to a flux concentrator, through which current is passed; the flux concentrator includes copper or graphite; the penetration depth of the transient magnetic field into the reinforcement material is less than or about the same as the thickness of liquid metal plus the portion of the reinforcement material that has been infiltrated by the metal; the method includes adjusting the frequency of the current so that said current is greater than or about equal to that required to maintain the penetration depth of the magnetic field into the reinforcement material to less than or about the same as the thickness of liquid metal plus the portion of the reinforcement material that has been infiltrated by the metal; the discharge coil is supplied with current by one or more capacitors; the discharge coils are adapted to substantially encircle the liquid metal and the reinforcement material; the discharge coils are of the solenoid type; the discharge coils are substantially flat spiral coils; the substantially flat spiral coils are placed on one side of the substantially liquid metal and the propelling occurs from that one side; a cooling source placed on the other side of the substantially liquid metal cools the composite after the metal has been propelled into the reinforcement material; and the substantially flat spiral coils are placed on both sides of the reinforcement material.

In yet another aspect, the invention features a method for the production of metal matrix composites, including placing a quantity of substantially solid metal into a heat resistant vessel, heating the metal until substantially liquid, immersing in the metal a preform of a reinforcement material, placing the heat resistant vessel containing the metal and the reinforcement material in the proximity of the source of an inactive transient magnetic field, sufficient, when activated, to produce an electromagnetic body force within the metal through the interaction of the transient magnetic field and eddy currents induced by the transient field within the metal, and activating the transient magnetic field, thereby propelling the metal into the reinforcement material.

In yet another aspect, the invention features a method for the production of metal matrix composites, including placing a reinforcement material into a heat resistant vessel, substantially surrounding the reinforcement material with a quantity of substantially solid metal, heating the metal until substantially liquid, placing the heat resistant vessel in the proximity of the source of an inactive transient magnetic field, sufficient, when activated, to produce an electromagnetic body force within the metal through the interaction of the transient magnetic field and eddy currents induced by the transient field within the metal, and activating the transient magnetic field, thereby propelling the metal into the reinforcement material.

In yet another aspect, the invention features a method for the continuous production of a metal matrix composite including the steps of conveying substantially liquid metal into an infiltration region, conveying a reinforcement material into the infiltration region and into the vicinity of the liquid metal, infiltrating the reinforcement material with the liquid metal by subjecting the liquid metal to a magnetic field, and conveying the infiltrated composite out of the infiltration region.

In preferred embodiments of this aspect, the reinforcement material includes particles, fibers, whiskers, or rods; the particulates includes silicon carbide particles; the fibers comprise carbon fibers; the fibers conveyed into the infiltration region are uniaxially oriented and are maintained in this uniaxial orientation during the infiltrating step.

In yet another aspect, the invention features an apparatus for producing metal matrix composites using electromagnetic body forces, including an infiltration zone having adjoining liquid metal and reinforcement material subzones, and an electromagnetic field source, capable of being activated and deactivated, adjacent to the liquid metal subzone of the infiltration zone, that produces a transient magnetic field and associated eddy currents within the metal, the electromagnetic field source oriented so as to propel the metal into the reinforcement material subzone of the infiltration zone.

In preferred embodiments of this aspect, the electromagnetic field source surrounds the infiltration zone; the electromagnetic field source includes a discharge coil; the discharge coil includes a spiral coil adjacent to one side of the infiltration zone; the apparatus additionally includes at least one capacitor bank and a triggering circuit through which the capacitor bank discharges current through the discharge coil; the apparatus additionally includes a flux concentrator coupled to the discharge coil; the flux concentrator includes copper or graphite; the infiltration zone is defined by a heat resistant crucible; the reinforcement material is a preform and the crucible additionally includes an apparatus for lowering and raising a preform into and out of the infiltration zone; the apparatus for lowering and raising the preform into and out of the infiltration zone includes a bobbin centered within the crucible; the bobbin guides the flow of metal propelled by the electromagnetic field source in a direction radial to the central axis of the crucible; the infiltration zone is defined by a heat resistant tube; and the apparatus additionally includes conveying apparatus to convey reinforcement material through the heat resistant tube.

In yet another aspect, the invention features an apparatus for producing metal matrix composites using electromagnetic body forces, including an infiltration zone having adjoining liquid metal and reinforcement material subzones, heating apparatus surrounding the infiltration zone able to maintain metal placed within the liquid metal subzone of the infiltration zone in a liquid state, and an electromagnetic field source, capable of being activated and deactivated, adjacent to the liquid metal subzone of the infiltration zone, that produces a transient magnetic field and associated eddy currents within the metal, the discharge coil oriented so as to propel the metal into the reinforcement material subzone of the infiltration zone.

In preferred embodiments of this aspect, the heating apparatus includes a thermostatically controlled heating element surrounding the electromagnetic field source.

Infiltration in this manner and using this apparatus has many advantages. Electromagnetic body forces literally propel the metal into the reinforcement material. No additional apparati are required to push the metal into the reinforcement material, rendering unnecessary other pressure-inducing devices and pressure-resistant or pressure-containing vessels.

Infiltrating metal velocities are potentially high and can be controlled by controlling the electric pulse and the magnetic field. Neither friction nor pressurized gas losses diminish the efficiency of the infiltration process.

DESCRIPTION OF THE PREFERRED EMBODIMENT

We now turn to the structure and operation of the preferred embodiments, first briefly describing the drawings.

Figure 5:
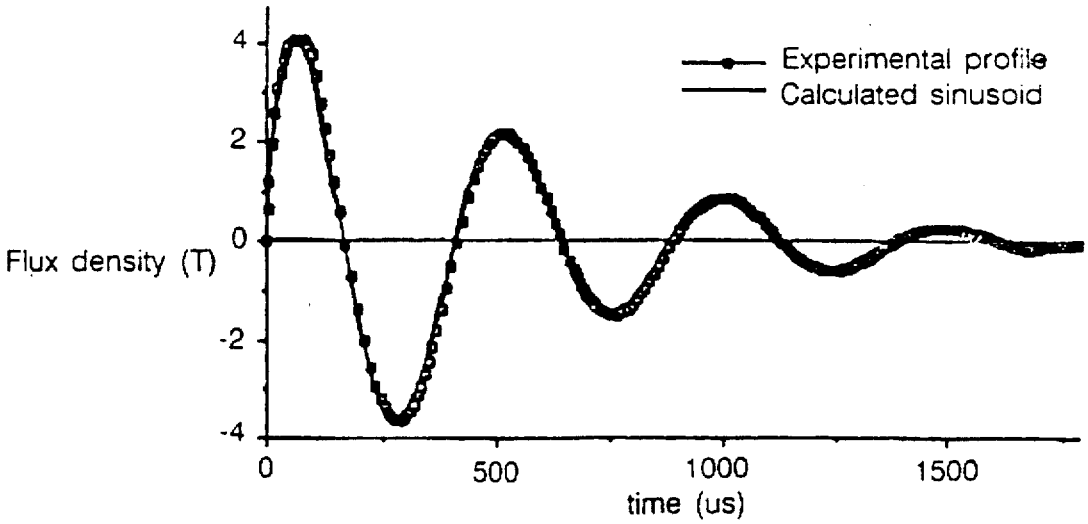

FIG. 5 compares the magnetic flux density of a search coil to that of a damped sinusoid.

Figure 6:
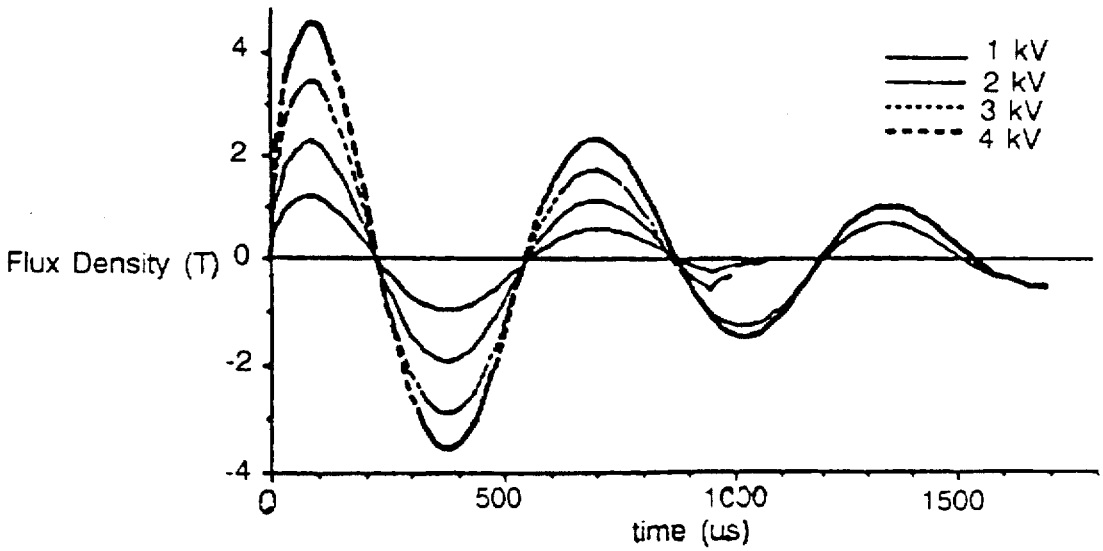

FIG. 6 show the flux profiles in a furnace for various discharge voltages (apparatus 1).

Figure 7:
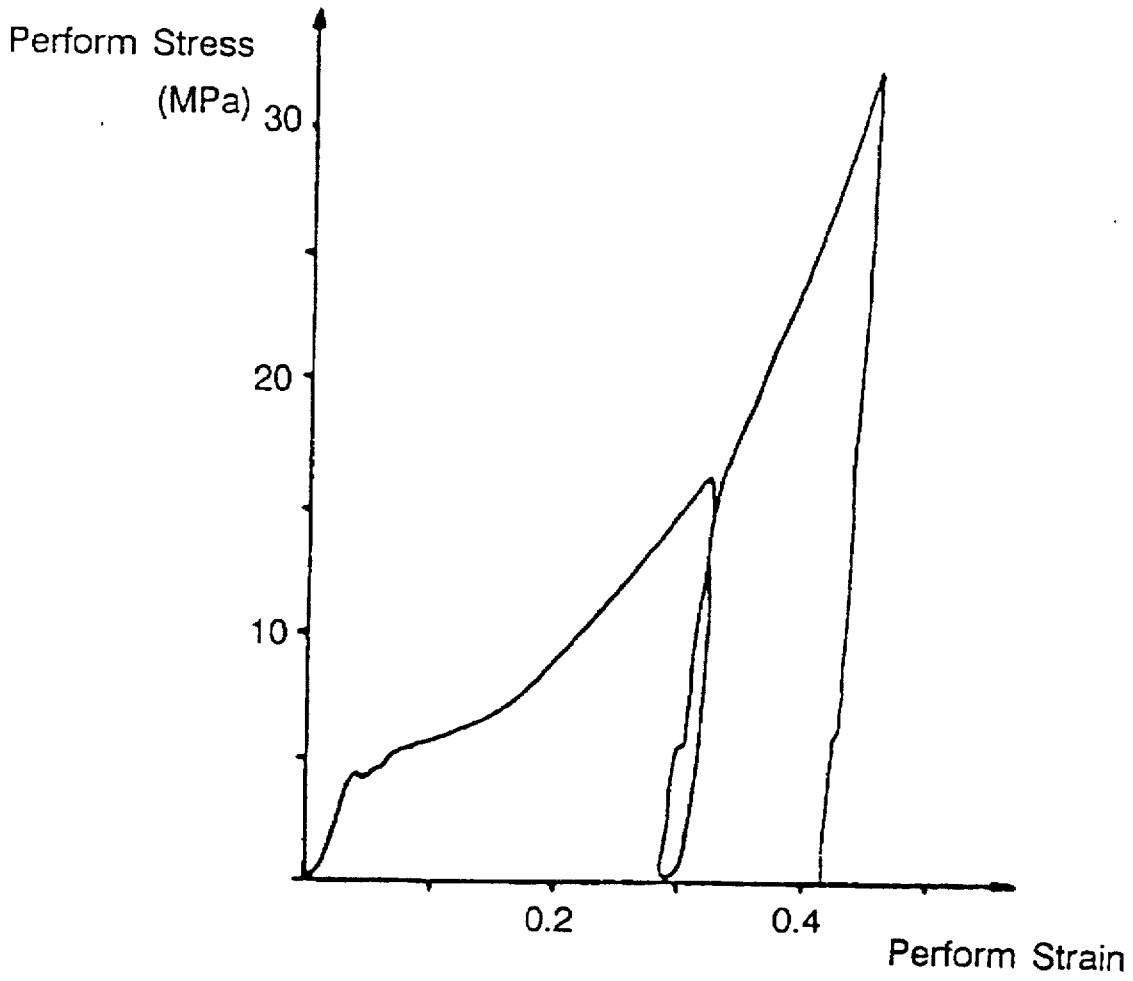

FIG. 7 is a stress-strain curve in compression for a 24 volume percent Saffil™ preform at 673° K.

Figure 8:
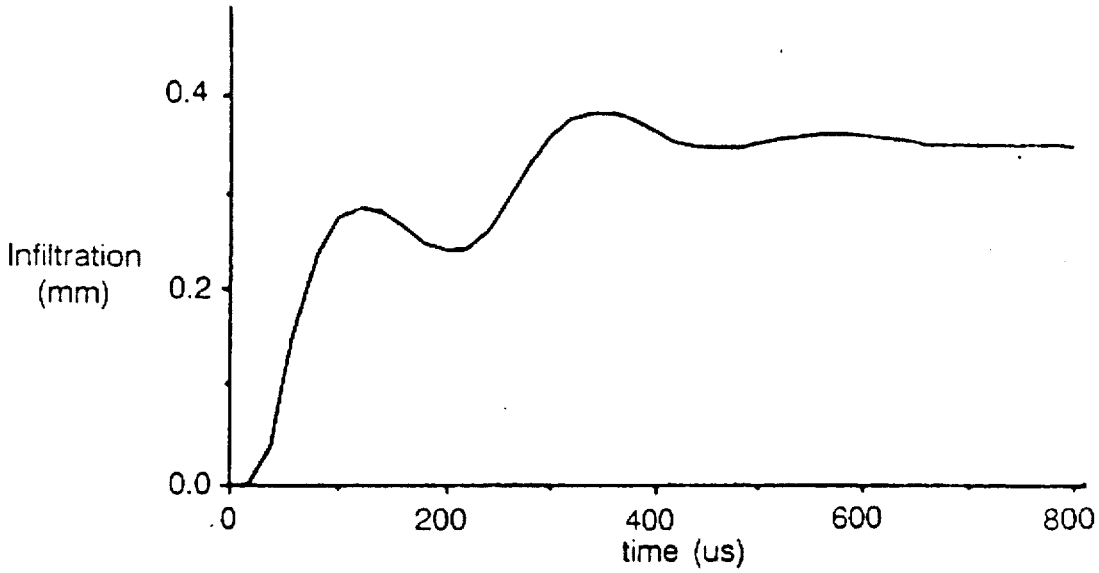

FIG. 8 shows the distance a preform is infiltrated over the course of a typical discharge.

Figure 9:
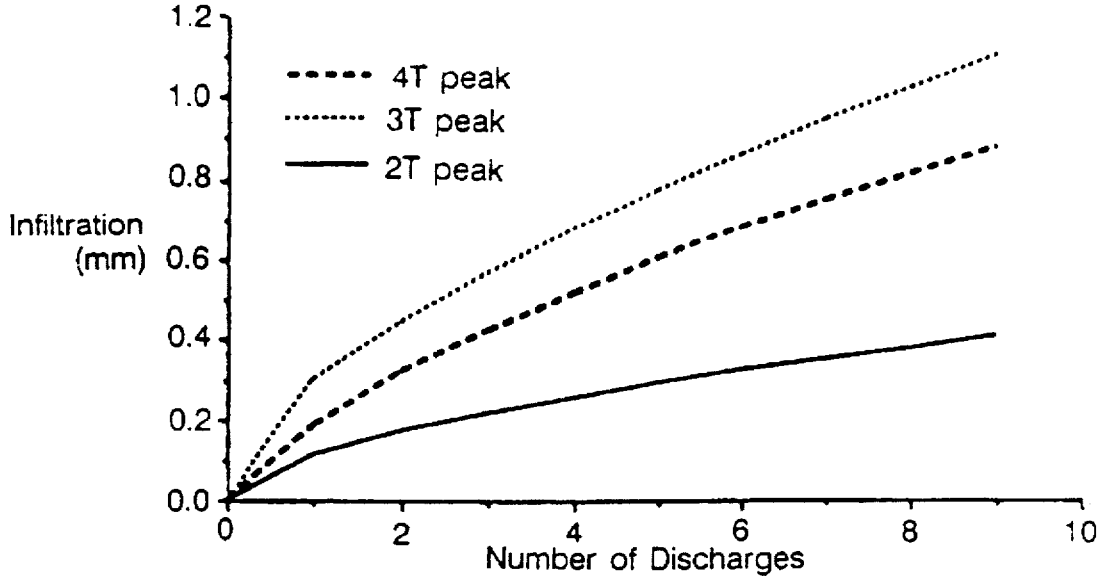

FIG. 9 shows the cumulative infiltration distance after each of nine 3 kHz discharges.

Figure 10:
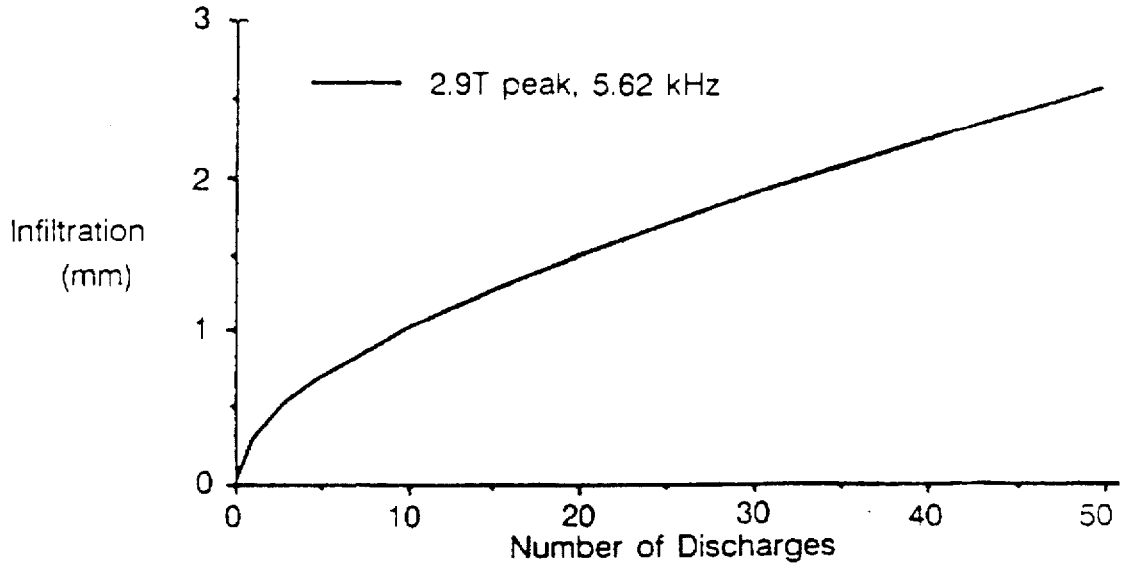

FIG. 10 shows the cumulative infiltration distance after each of fifty 5.6 kHz discharges.

Figure 11:
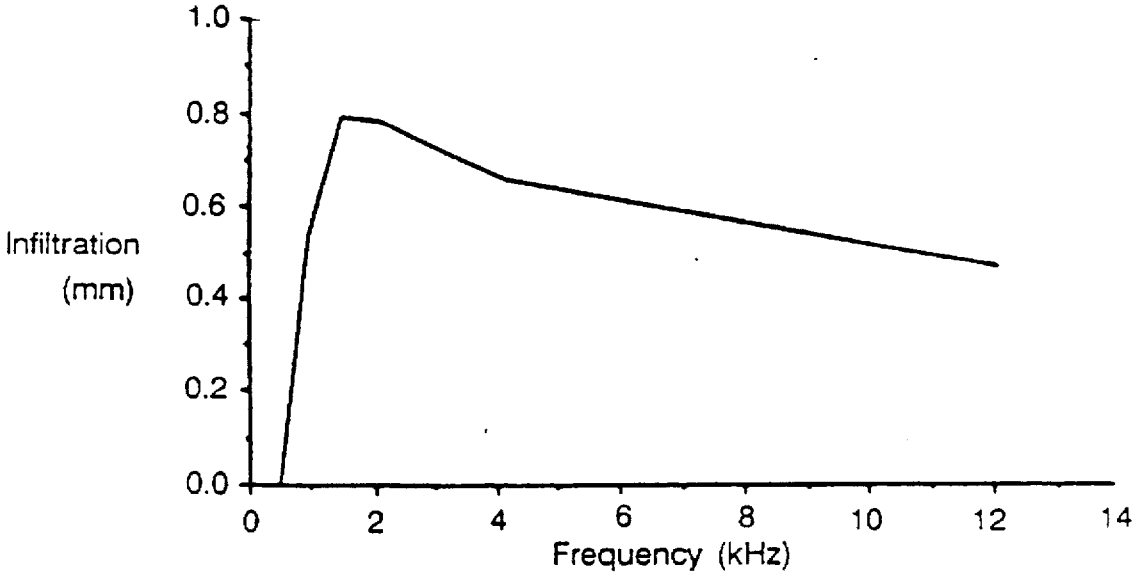

FIG. 11 shows predicted infiltration distance after five discharges with a 3 tesla peak.

Figure 1:
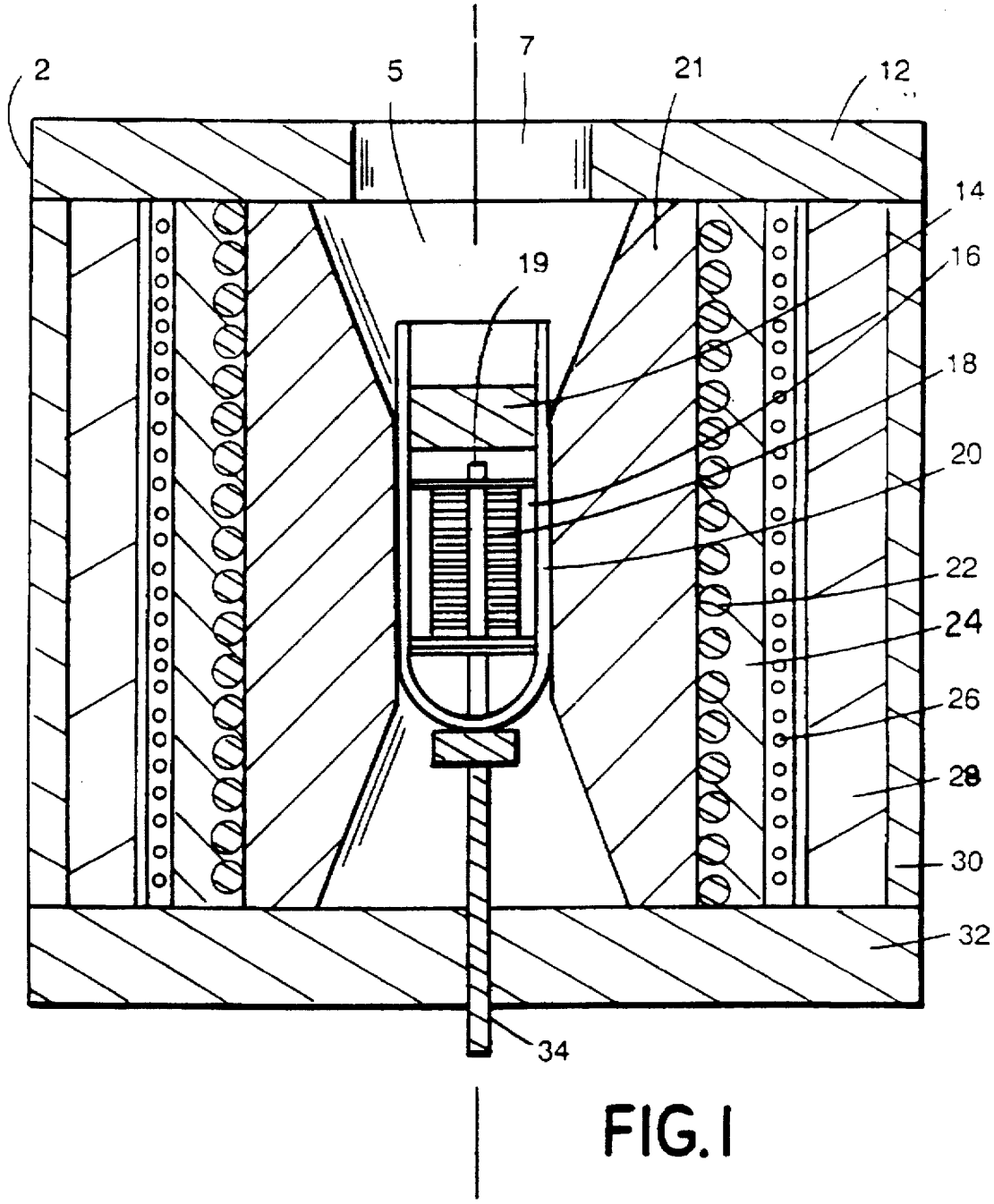
FIG. 1 is a cross-section of an apparatus for producing cylindrical or tubular metal matrix composites.
Figure 2:
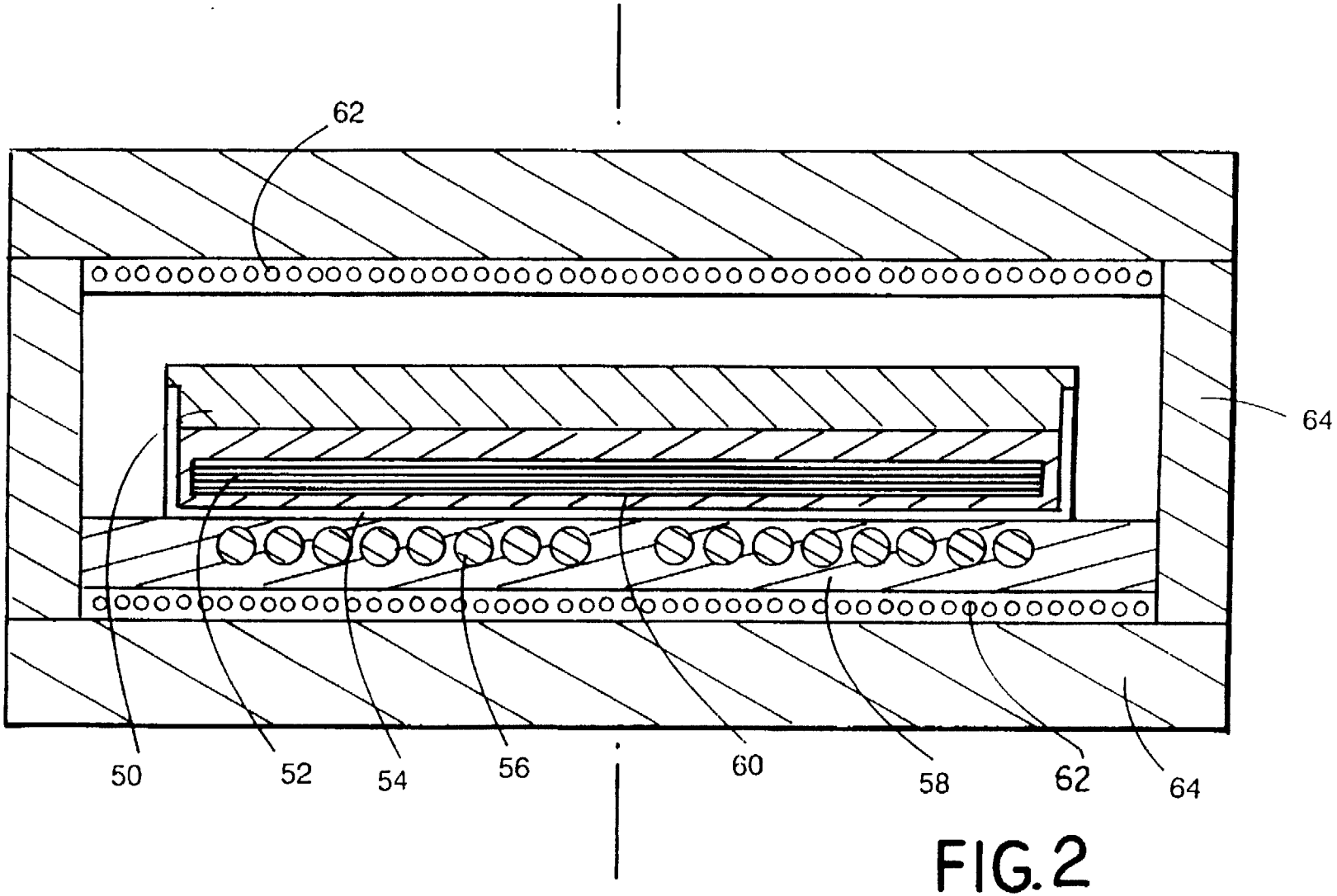
FIG. 2 is a cross-section of an apparatus for producing planar metal matrix composites.

Metal matrix composites may be formed in the devices shown in FIGS. 1 and 2. Common to both is the function of the electrical components that generate the electromagnetic body forces. The arrangement of those components differ in each, however, as do the arrangement of the heating components, as their arrangement is determined by the geometry of the composite to be produced.

In FIG. 1, copper discharge coil 22 is 0.25 inch copper wire electrically connected through any conventional triggering circuit to a bank of capacitors (not shown) with a total capacity of 640 microfarads and a power supply able to produce 4.5 kilovolts (not shown). The coil 22 is arranged as a solenoid and is equipped with copper flux concentrator 21 for concentrating the magnetic field produced by the energized discharge coil 22. The height of the inner radius of concentrator 21 is one third the height of the outer radius, and as a result, increases the flux some 300% in the infiltration zone defined by the inner height.

A unit made by the Magneform Corporation (presently Maxwell Laboratories, San Diego, Calif.) for the electromagnetic forming of solid metal, was also used with the above-described coil to obtain higher frequency discharges. This unit is of lower capacitance than the first apparatus, but charges to a higher voltage to obtain comparable peak magnetic flux values. Total stored energy of the Magneform machine at full voltage is 8 kJ. The Magneform apparatus uses several ignitron tubes.

A compromise must be reached in designing a coil so as to keep the frequency high enough to concentrate the magnetic field near the molten metal surface, yet still generate a sufficiently high magnetic field intensity. In this work, coils having from 6 to 18 turns were used.

The heating components form the bulk of the FIG. 1 embodiment. Insulated chamber 2 includes an insulating top 12, insulating base 32, and wall 30. Insulation 28 surrounds heating elements 26. Discharge coil 22, encased within refractory cement 24, encircles flux concentrator 21.

In a preferred embodiment, a preform 18 of a reinforcement material such as silica bonded Saffil™ alumina fibers is inserted into crucible 20. To ensure the preform 18 remains precisely centered within the crucible 20, it was mounted on a bobbin 19 as shown in the apparatus of FIG. 1. This arrangement has several further advantages: the infiltrated composite can be withdrawn from the crucible while the matrix is still molten, and the flanges of the bobbin help to constrain the metal flow to a radial direction, minimizing axial flow. Several bobbin designs were used, all of which were functionally identical, varying only in the materials chosen, the central rod being either of steel or high density alumina. The fiber preforms were infiltrated along their plane of pressing.

Crucible 20 is preferably of a heat-resistant ceramic such as alumina. In one embodiment, molten aluminum 16 is poured around a preform 18 placed within the crucible, covering it. Insulating plug 14 caps the preform/melt mixture to prevent stray metal flow during infiltration. The topped crucible is then lowered into the central cavity 5 of chamber 2 through opening 7 by crucible lifting mechanism 34.

In another embodiment, the required amount of aluminum was first added to each crucible, and placed in a holding furnace (not shown) set at 973° K with an alumina plug. The preforms, already mounted in their bobbins, were loaded into the furnace once the aluminum had begun to melt in the crucibles. Once the metal was fully molten, the preform-bobbin assembly 7 was immersed in the melt, and allowed to equilibrate for 5 minutes. The crucible with its preform was then withdrawn from the holding furnace and lowered into the infiltrating furnace, which had been preheated to 973 K. At this point the ceramic plug was pushed into the top of the crucible so as to rest upon the melt surface.

Discharging the charged capacitors through discharge coil 22 creates a very high pulse of current in the coil which in turn creates a correspondingly high transient magnetic field inside crucible 20 via the concentrator. Fields of about 2 to 10 tesla were used, although higher or lower strength fields may be used depending on the other system variables. Currents of from about 20,000 to about 50,000 amperes were used, although this too may be higher or lower in other systems.

The penetration depth of the magnetic field into the molten metal is preferably no more than the total thickness of the layer of metal. Increasing the frequency of the current reduces the penetration depth of the field, and is one way to adapt the apparatus to various possible geometries.

The transient magnetic field induces electrical currents in the molten metal 16 which interact with the magnetic field produced by coil 22. This interaction produces a net body force on molten metal 16 around preform 18, forcing it away from coil 22 and flux concentrator 21 and into the preform. Multiple discharges assure penetration of the liquid to the desired depth within the preform. Capillary and frictional forces that oppose the infiltration of the liquid are insufficient to prevent substantial infiltration of the preform.

Room temperature coils were also used. The procedure is identical to that above, except that the crucible should be returned to the holding furnace within 30 seconds of its transfer to the discharge coil, since it was determined that freezing of the melt began 45–60 seconds after the hot crucible was introduced into the cold concentrator. The number of discharges possible during this 30 seconds time interval varied between 3 and 8, depending upon the voltage of the discharge. Several of the samples thus had to be reheated more than once to obtain the required number of discharges.

The current produced by the apparatus has the character of an exponentially decaying sinusoid after the first half-cycle. A typical flux profile is shown in FIG. 5. The voltage to which the capacitors are charged can be varied, and is one of the main process parameters, since this determines the intensity of the magnetic pulse. The discharges can be repeated as soon as the capacitors have recharged (two to five seconds in the laboratory apparatus). Other characteristics of the pulse, such as its frequency and damping constant, depend upon the capacitance, inductance, and resistance of the electrical circuit, which are largely determined by the design of the coil and capacitance of the energy modules. The geometry of the process is flexible, since the coil, the crucible, and the preform-need not be cylindrical. With a quantitative understanding of its kinetics, infiltration lengths can also be accurately controlled.

In order to know the precise shape of the flux density B generated inside the concentrator as a function of time, a signal that is proportional to B was obtained by measuring voltage with a digital oscilloscope across a copper resistor through which the primary coil current flows during discharges. For a given frequency (since the performance of the concentrator varies with frequency) the magnetic flux density is proportional to the primary coil current.

A search coil was designed that produces a voltage signal proportional to the time derivative of magnetic flux density. This search coil was calibrated against a RFL Model 912 Gaussmeter (RFL Industries Inc., Boonton, N.J.). This allowed measurement of the peak magnetic field intensity, $B_o$, assuming the first peak of the magnetic field is a sinusoid (FIG. 5). This value of $B_o$, in combination with output from the resistor, yields the curve of magnetic field versus time. $B_o$ was calibrated as a function of peak intensity of current measured by the transducer for each set of coil and concentrator used. In order to calibrate the furnaces at 973° K a thermally and electrically insulating sleeve was put over the search coil to enable it to withstand the temperature within the empty furnace for the few seconds that it takes to make each measurement. The resulting curves of $B_o$ versus current peak intensity were then used to determine the pulsed magnetic field profiles without using the magnetic probe during infiltration experiments.

The flux density traces for several discharge voltages are presented in FIG. 6 for an 18 turn furnace connected to the first described apparatus. This set-up provides an underlying frequency of 1.52 kHz, where the underlying frequency is the discharge frequency of the second and all subsequent half cycles. With each combination of coil and machine, H varied in time as an exponentially decayed sinusoid, but with a change in frequency after the first half-cycle.

These data were use to model the process. Additionally, preform mechanical properties were measured. The curve of stress versus engineering strain $e=(h-h_o)/hy_o$, where h is preform height during the test and $h_o$ is initial preform height, is given in FIG. 7. The resulting curve is seen to be approximately bilinear for stresses under 7 MPa.

The infiltrated distances for samples of 24 vol % Saffil™ infiltrated with aluminum are presented in Table I for each preform diameter, discharge energy and discharge frequency. Sample 20 and 21 showed significant reduction in the diameter of the preforms toward the middle of their length. With more discharges than in these sample, the preforms could not be retrieved from the melt, indicating that they had collapsed.

TABLE 1

Experimental Infiltration Distances for Aluminium/24 vol % Saffil ™ Samples.

| Sample Number | Discharge Frequency (kHz) | Peak Flux Density (T) | Preform Diameter (mm) | Number of Discharges | Depth of Infiltration (mm) |
|---|---|---|---|---|---|
| 1 | 1.52 | 2.3 | 16 | 3 | 0.0–0.3 |
| 2 | 1.52 | 2.3 | 16 | 9 | 0.5–0.7 |
| 3 | 1.52 | 3.4 | 16 | 3 | 0.4–0.8 |
| 4 | 2.09 | 2.0 | 16 | 3 | 0.1–0.3 |
| 5 | 2.09 | 2.0 | 16 | 9 | 0.3–0.5 |
| 6 | 2.09 | 2.0 | 16 | 21 | 0.4–0.7 |
| 7 | 2.09 | 3.0 | 16 | 3 | 0.5–0.6 |
| 8 | 2.09 | 3.0 | 16 | 9 | 0.8–1.1 |
| 9 | 2.62 | 2.9 | 16 | 3 | 0.4–0.7 |
| 10 | 2.62 | 2.9 | 16 | 9 | 0.6–1.1 |
| 11 | 5.63 | 2.9 | 16 | 3 | 0.3–0.5 |
| 12 | 5.63 | 2.9 | 16 | 9 | 0.4–0.7 |
| 13 | 5.63 | 2.9 | 13 | 9 | 0.9–1.2 |
| 14 | 5.63 | 2.9 | 18 | 9 | 0.6–0.8 |
| 15 | 10.9 | 2.7 | 16 | 3 | 0.05–0.1 |
| 16 | 10.9 | 2.7 | 16 | 9 | 0.0–0.3 |
| 17 | 10.9 | 2.7 | 16 | 3 | 0.3–0.6 |
| 18, 19 | 10.9 | 3.8 | 16 | 9 | 0.2–0.7 |
| 20 | 2.62 | 2.6 | 10 | 16 | 1.1–1.6 |
| 21 | 2.62 | 2.6 | 10 | 24 | 1.4–1.8 |
| 22 | 2.62 | 2.1 | 16 | 9 | 0.9–1.1 |

COMPOSITE MICROSTRUCTURE

Figure 3:
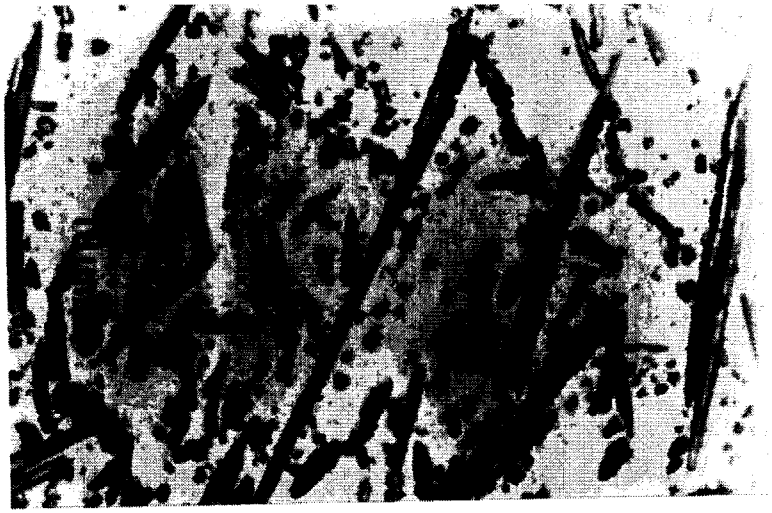
FIG. 3 is a micrograph of a composite produced according to the invention.
Figure 4:
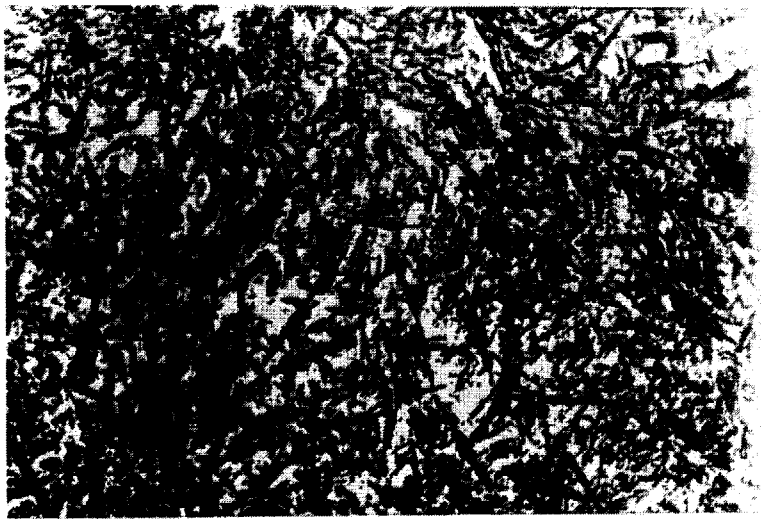
FIG. 4 is a micrograph of the composite of FIG. 3 at higher magnification.

Substantially complete infiltration can be achieved by carrying out the foregoing procedure, as shown in composites produced in this manner, FIGS. 3 and 4. The micrograph of FIG. 3, taken at 100× magnification, and of FIG. 4, at 1000× magnification, show negligible residual porosity in a preform having 24% volume percent reinforcing phase.

The samples shown in FIGS. 3 and 4 are of an aluminum infiltrated Saffil™ alumina preform. The 16 mm diameter, 5 cm long cylindrical preform had 4% silica added as a binder, and had fibers 3 μm in diameter. After placement in the crucible and into the infiltration zone where the magnetic field was strongest, ten pulses of current were discharged through the coils at 4 second intervals. Each produced a magnetic field with a strength of about 4 tesla. Each 3000 volt pulse was oscillatory with a frequency of about 3000 hertz. 30,000 amperes of current was produced by each pulse. The infiltration zone temperature was about 690°–710° C.

Overly high magnetic field strengths or too numerous pulses could lead to undesirable fiber or particle degradation. The micrographs for the FIGS. 3 and 4 specimens, however, show that the preform was not significantly degraded, as long fibers remained intact in spite of the high velocity infiltration. (While broken fibers are present, the blend shown in these micrographs is characteristic of the pressed virgin preforms.) The preform was infiltrated to a depth that varied with process parameters, to a maximum of 2.5 mm.

Samples produced are completely infiltrated to within a distance of about 300 μm from the infiltration front. Nearer the infiltration front, porosity gradually increases, leading to a relatively sharp infiltration front. Molten aluminum does not dewet Saffil™ preforms spontaneously once these are infiltrated. Therefore, provided an elevated value of pressure was experienced by the metal at any region of the composite during infiltration, that region will remain fully infiltrated. The low porosity found in the preforms is a result of the relatively high pressures generated by the Lorentz forces (up to 6 MPa), and, at low frequencies, of the occurrence of a reversal in the Lorentz force, which induces elevated pressures near the infiltration front. Despite the relatively high pressures applied, long alumina fibers present in the preform are unbroken in the infiltrated composites. This is in agreement with calculations, which predict that around optimum infiltration conditions, the preforms do not deform to an extent that would break the fibers significantly.

The process may be controlled by varying the current through the coils, as well as the number, duration, and frequency of the pulses. Optimum conditions will vary with preform shape and size, fiber or particle size, and matrix metal composition. The geometry of each of the coil, crucible, melt, and preform may also be varied to optimize infiltration with varied reinforcement and matrix materials and geometries.

PROCESS PARAMETERS

FIG. 8 shows graphically how infiltration distance varies during a typical discharge of 2.1 kHz and 3 tesla peak, damping factor of 0.5 mS. It is seen that as the body force builds up, no infiltration is predicted until the body force is sufficiently large to overcome the capillary forces. At this point, there is a rapid acceleration of the melt into the preform during which the fluid friction forces build up to slow the flow. The melt advances until, as the Lorentz forces fall again, it is brought to a halt by the combined action of fluid friction and capillary forces. When the Lorentz force becomes negative, the melt progresses backwards appreciably, even though the magnitude of the negative forces are much lower than the forward forces at other parts of the discharge cycle. This is because capillary forces were assumed not to impede backward metal flow.

FIG. 9 shows cumulative infiltration depth for one to nine discharges for peak flux intensities of 2, 3, and 4 tesla, at 2.1 kHz discharge frequency and a damping constant of 0.5 mS. The model predicts that the infiltration increment from the first few discharges is more than for subsequent discharges. This is clearly because earlier discharges have lower fluid friction forces to overcome due to the shorter infiltrated length. Calculations show, however, that after the first few discharges, the infiltration depth increment per discharge becomes nearly constant, only decreasing by a very small amount as infiltration progresses, FIG. 10. This is perhaps the most important finding of the calculations: provided an apparatus capable of subjecting the metal to many magnetic pulses is designed and the preform is able to withstand the forces generated, there is theoretically little limitation to the depth of infiltration that can be achieved using this process for this system. FIG. 9 also demonstrates that there is an optimum discharge intensity for a given frequency. This effect is due to preform compression—if the discharge is too intense the preform compresses to such an extent that the increased fiber volume fraction lowers preform permeability so the gain in propelling force is more than negated by the increased capillary and fluid friction forces.

FIG. 11 shows the cumulative infiltration predicted after 5 discharges with 3 tesla peak, for a wide range of frequencies having identical relative damping coefficients. At very low frequencies the penetration depth is so large, in relation to the melt ring thickness, that the Lorentz forces generated are insufficient to overcome capillary forces, and so zero infiltration is predicted. At high frequencies, although the body force is higher, its duration is much shorter. Inertia is then more of a limitation to infiltration, and the higher velocities lead to greater fluid friction losses in the infiltrated portion of the liquid composite. These two opposing effects lead to an optimum frequency for a fixed number of discharges around 1.5 kHz predicted for this crucible preform geometry and infiltration parameters.

While aluminum was used in the foregoing embodiment, other matrix metals may be used. Magnesium, lead, tin, zinc, nickel, cobalt, beryllium, titanium, and steel (iron) may be used alone or in alloys. Materials such as silicon carbide, boron, carbon, aluminum oxide, silicon nitride, boron carbide, silicon oxide, or steel, in fibrous, particulate, or other geometries are among other acceptable reinforcement materials.

The process of this embodiment, though discontinuous in the sense that the motive coil current is generally not continuous even in a batch mode, is easily adapted to a continuous casting process by using a repeated pulsed current. As the metal is driven by a body force and not a surrounding pressure, the infiltration zone may be partially open and need not be adapted to retain pressure. Since they remain accessible during the pressurization stage of the process, metal and reinforcement may be continuously fed into the infiltration zone to be retrieved by continuously casting the resulting infiltrated composite. The unsealed process zone also permits very short cycle-times since there is no need to retrieve any pistons, vent pressurized gas, and open pressure-tight vessels.

While FIG. 1 depicts an embodiment where preforms are infiltrated in a batch mode, that apparatus may be easily adapted to continuously cast a metal matrix composite. In such an embodiment, the ceramic crucible would be replaced by a ceramic tube. The FIG. 1 apparatus would be open along its central axis not only at the top as shown, but also at the bottom to accommodate a continuous length of rod or tube preform. A chill zone at the discharge end would solidify the composite before it exited the apparatus and was recovered. The reinforcing phase preform, e.g. a rod or a hollow cylinder, would be fed through the apparatus and infiltrated with liquid metal as it passed through the infiltration zone within the flux concentrator's concentrated magnetic field.

The geometry of the discharge coil, any flux concentrator that may be used, and the heating components can be modified depending on the type and geometry of the composite to be produced. While the cylindrical or tubular composite produced by the apparatus of FIG. 1 used a solenoid-type coil, a planar composite would use a flat "pancake" spiral coil, FIG. 2. Such a configuration would allow infiltration from one side of a flat, essentially two-dimensional preform, such as one with woven continuous fibers.

FIG. 2 shows such an apparatus, with a furnace and coil adapted to make planar composites. Heating elements 62 within insulating walls 64 would keep the temperature of ceramic crucible 54 above the melting point of the metal 60. After placing metal 60 and a flat preform 52 into the crucible, refractory plug 50 would cap the crucible to prevent splashing. The flat, spiral discharge coil 56, embedded in refractory cement 58, would then be energized and propel liquid metal 60 into the preform.

The composite produced by an apparatus of the type in FIG. 2 could be chilled from the side opposite the infiltration side (here, the refractory plug side), which would lead to more rapid solidification of the matrix. For example, refractory plug 50 could serve as a chill, and the preform would be positioned flush with the underside of the plug/chill prior to infiltration. The reduced exposure of the fibers to high melt temperatures would reduce possible fiber degradation, leading to improved composite microstructure and properties.

A continuous casting version of the planar embodiment of FIG. 2 is also possible. As with the continuous version of the cylindrical embodiment, the ends of the insulating walls would be opened to permit entry of the preform and recovery of the finished composite. Pulsed treatment of the materials within the infiltration zone and the movement of the materials into and out of the infiltration zone would continuously cast a composite.

In another embodiment, silicon carbide particles were packed into a cylindrical cavity drilled into an aluminum slug. This was placed into a ceramic crucible and heated until the aluminum was molten. Since wetting between silicon carbide particles and molten aluminum is poor, the metal did not spontaneously infiltrate the particles. The crucible was then placed into the central cavity formed by a discharge coil. The capacitor banks discharged 3 kV, 9 times, into the coil, at which point mechanical problems caused a pause of several hours before another 8 discharges were carried out. The metal remained molten at all times.

Micrographic analysis of the product showed that the particles in the composite had undergone substantial undesirable reaction with the metal because of the pause between the two groups of discharges. Nevertheless, the composite was substantially homogeneous, with only a few large pores scattered throughout. Given more refined reaction conditions, for example, adjusted melt temperature, discharge number, and discharge strength, it is believed that the large-scale porosity can be eliminated.

This experiment demonstrated that substantially homogeneous composites can be made using electromagnetic body forces. No infiltration front was present within the composite produced by this embodiment and no entrained gas was evident. A substantially uniform product was produced.

Preliminary work with this embodiment demonstrates that substantially homogeneous metal matrix composites may be produced in more rapid and economical fashion using electromagnetic body forces. These composites may either be cast from the crucible or continuously cast from an opening in the bottom of the crucible to produce ingots having homogeneously dispersed reinforcement particles. The ingots may be further processed into any desireable products.

In a further embodiment, a 15 mm diameter bundle of carbon fibers held together with circumferential tows of carbon fibers and wrapped around a threaded steel rod were placed in the center of a crucible. The metal was liquefied. The crucible was then placed within the cavity of the discharge coil and subjected to multiple discharges. The electromagnetic body forces propelled the metal into the tows, infiltrating them.

Micrographic analysis showed that complete infiltration had not taken place; however, more than half of the tow was infiltrated. Full infiltration was most likely not achieved because the fibers were not sufficiently constrained from moving around during discharges. Under proper conditions, however, substantially complete infiltration is expected to occur. The metal matrix composite thus produced will have anisotropic properties, having its greatest strength lying parallel to the axis of the fibers within the composite. Composites with parallel reinforcement fibers can be cast into short lengths from the crucible, or continuously cast into longer rods.

In the foregoing embodiments, the body force is created by an induced magnetic field. The invention is not limited to such embodiments, however. In another embodiment, for example, a molten metal could be subjected to a separately applied electric field such as via electrodes immersed into the metal. If this occurred while the metal was within a magnetic field, the interacting fields would thus produce electromagnetic body forces that would propel the molten metal.

We claim:

1. A method for the production of metal matrix composites comprising the steps of:

placing a substantially liquid metal in the vicinity of a reinforcement material and providing a source of an inactive transient magnetic field in the vicinity of the substantially liquid metal, sufficient, when activated, to produce an electromagnetic body force within the metal through the interaction of the transient magnetic field and eddy currents induced by the transient magnetic field within the metal; and activating the transient magnetic field, thereby propelling the substantially liquid metal into the reinforcement material.

2. The method of claim 1 wherein the activating step is repeated.

3. The method of claim 1 wherein the metal comprises at least one of aluminum, nickel, cobalt, copper, beryllium, lead, tin, zinc, magnesium, titanium, or iron.

4. The method of claim 1 wherein the reinforcement material comprises a ceramic.

5. The method of claim 1 wherein the reinforcement material comprises fibers, platelets, whiskers, particles, or rods.

6. The method of claim 5 wherein the reinforcement material is shaped into a preform.

7. The method of claim 1 wherein the reinforcement material comprises at least one of silicon carbide, boron, tungsten, carbon, silicon nitride, boron carbide, silicon oxide, aluminum oxide, titanium, or steel.

8. The method of claim 1 wherein the propelling step additionally comprises subjecting the substantially liquid metal to an electrical field.

9. The method of claim 1 wherein the transient magnetic field is produced by a discharge coil through which electric current is passed.

10. The method of claim 9 wherein frequency and damping constant of the activated transient magnetic field are tailored to geometry of the discharge coil, reinforcement material, metal, and the depth of which the metal is to be propelled into the reinforcement material.

11. The method of claim 9 wherein the current is an oscillating current.

12. The method of claim 1 wherein the transient magnetic field is produced by a discharge coil coupled to a flux concentrator, through which current is passed.

13. The method of claim 12 wherein the flux concentrator comprises copper or graphite.

14. The method of claim 13 wherein the discharge coils are adapted to substantially encircle the liquid metal and the reinforcement material.

15. The method of claim 14 wherein the discharge coils are of solenoid type.

16. The method of claim 12 wherein penetration depth of the transient magnetic field into the reinforcement material is less than or about the same as the thickness of liquid metal plus the portion of the reinforcement material that has been infiltrated by the metal.

17. The method of claim 16, including adjusting the frequency of the current so that said current is greater than or about equal to that required to maintain the penetration depth of the magnetic field into the reinforcement material to less than or about the same as the thickness of liquid-metal plus the portion of the reinforcement material that has been infiltrated by the metal.

18. The method of claim 12 wherein the discharge coil is supplied with current by one or more capacitors.

19. The method of claim 12 wherein the discharge coils are substantially flat spiral coils.

20. The method of claim 19 wherein the substantially flat spiral coils are placed on one side of the substantially liquid metal and wherein the propelling occurs from that one side.

* * * * *